United States Patent [19]

Horowitz

[11] Patent Number: 4,996,463

[45] Date of Patent: Feb. 26, 1991

[54] AUXILIARY LIGHTING SYSTEM FOR HIGH INTENSITY DISCHARGE LAMP

[76] Inventor: Victor Horowitz, 3359 Ocean Ave., Oceanside, N.Y. 11572

[21] Appl. No.: 396,552

[22] Filed: Aug. 21, 1989

[51] Int. Cl.[5] ..... H05B 41/14

[52] U.S. Cl. ..... 315/250; 315/258; 315/312; 315/313

[58] Field of Search ..... 315/88, 92, 121, 127, 315/154, 210, 250, 258, 312, 313

[56] References Cited

U.S. PATENT DOCUMENTS

| | | | |
|---|---|---|---|
| 765,466 | 7/1904 | Flichtner | 315/92 |
| 3,699,382 | 10/1972 | Franke | 315/92 |
| 4,005,331 | 1/1977 | Horowitz | 315/92 |
| 4,151,445 | 4/1979 | Davenport et al. | 315/219 X |

*Primary Examiner*—David Mis

*Attorney, Agent, or Firm*—McAulay Fisher Nissen & Goldberg

[57] ABSTRACT

An auxiliary lighting system to be used with a high intensity discharge lamp having a solid state or electronic ballast. An auxiliary lamp is connected to a source of power through the normally closed contacts of a relay. The relay coil is in the input line to the solid state ballast. Above a predetermined threshold current to the ballast, the relay coil causes the normally closed contacts to open thereby extinguishing the auxiliary lamp. When the high intensity discharge lamp is turned on, or when there is an interrupt, the power requirements for the HID lamp are at a low point. Thus the input current to the solid state ballast is below the threshold, the contacts are closed and the auxiliary lamp is turned on.

5 Claims, 1 Drawing Sheet

AUXILIARY LIGHTING SYSTEM FOR HIGH INTENSITY DISCHARGE LAMP

BACKGROUND OF THE INVENTION

This invention relates to auxiliary lighting systems for use with high intensity discharge (HID) lamps and more particularly to provision of auxiliary lighting when the HID lamp is first turned on and when the HID lamp turns off due to power interrupt. These two conditions are known as cold start and hot interrupt.

The need for an auxiliary lamp and some of the background of the operation of these HID lamps is set forth in U. S. Pat. No. 4,005,331 issued Jan. 25, 1977 and entitled "High Intensity Discharge Lamp With Auxiliary Light".

High intensity discharge (HID) lamps have the great advantage of being energy efficient. High pressure sodium and metal halide lamps for example provide both high light levels and good color characteristics. The operation of many types of HID lamps requires the addition of ignitors to the ballast circuit in order to enable the arc to be struck. Conventional ballasts and solid state ballasts have been designed for use with HID lamps. Even with the inclusion of ignitors, there is still a period of time during initial start-up when the light output from the HID lamp is insufficient to enable safe entry into areas illuminated by these devices. This is called cold start. A period of several minutes may elapse before these lamps achieve their full light output.

Additionally, despite the inclusion of ignitors which generate high voltages to establish the arc within the HID lamp, if there is a momentary interruption in the power source, the lamp will not re-establish its arc for a period of time ranging from a minute to several minutes. This is called hot interrupt. During this time, as well as during normal start-up, it is desirable to provide auxiliary light.

When conventional ballasts are employed for HID lamps, it is common to place a relay which has a current sensing coil in the ballast secondary, in series with the HID lamp. A set of normally closed contacts is placed in series with an incandescent lamp and an AC power source. When the arc is established in the HID lamp, current flows through the current sensing coil and the normally closed contacts are driven open thereby extinguishing the auxiliary light. A device of this type provides auxiliary light only during times of hot interrupt. During hot interrupt, the HID lamp is too hot to enable the ignitor to re-establish an arc. As soon as the arc is re-established, the current flow to the HID lamp causes the current coil of the normally closed relay to drive the contacts open thereby switching the incandescent lamp off.

If auxiliary light during cold start is desired, i.e. when a cool HID is to be energized, additional components must be added. In view of the fact that the ignitor delivers pulses up to several thousand volts to the HID lamp, it is impractical to place voltage sensing coils across the HID lamp in order to sense normal operating parameters and open circuit conditions. The placement of such a voltage sensing coil is common with mercury vapor and conventional metal halide lamps which do not have ignitors. For HID systems which incorporate ignitors, the general means of providing auxiliary lighting during cold start is to employ a current sensing relay with normally open contacts in series with the ballast output and the HID lamp. The normally open contacts of this relay close when current flows to the HID lamp and, in turn, control a normally closed timing device which turns off the auxiliary incandescent lamp after a predetermined time period.

Solid state ballasts which incorporate the ignitor function have been developed for HID lamps. They offer advantages of cooler operation, less power loss and quieter operation. The use of a solid state ballast and ignitor creates difficult operating conditions for auxiliary lighting controls. The high voltage ignitor pulses which they generate require wire with special insulation characteristics which precludes the use of a conventional current sensing relay in series with the ballast output and the HID lamp. A typical ballast system of this type was developed by General Electric Company. Their 32 watt metal halide lamp that provides a light output similar to a 150 watt incandescent. The solid state ballast HID lamp combination uses a total of only 37.5 watts. The system provides 66.6 lumens/watt (over 3 times the 150 watt incandescent). The ignitor voltage and wire insulation requirements of the ballast precludes its use with conventional HID auxiliary lighting controls.

Accordingly, it is a major purpose of this invention to provide an auxiliary lighting system that can be employed with HID lamps having a solid state ballast and ignitor.

More particularly, the purpose of this invention is to provide a simple auxiliary lighting system with a minimum number of components, which is relatively inexpensive and can be employed with a wide range of HID lamps having a solid state ballast.

BRIEF DESCRIPTION

In brief, the auxiliary lighting system of this invention is employed with a high intensity discharge (HID) lamp in which the ballast is a solid state ballast. The ballast provides the required varying power input to the HID lamp during the two to six minute of the warm up. The older type ballasts, such as the reactor and the two-winding, constant-current ballasts are relatively inefficient and have a relatively constant input wattage requirement during turn on time and steady state operation of the lamp. Thus the input voltage and input current to these reactor or auto-transformer ballasts tend to be fairly constant throughout operation, including cold start and steady state operation.

By contrast, the more efficient solid state ballast has the advantage of having fairly constant efficiency during start up and steady state conditions. The power input to the HID lamp increases substantially during start up. For example, in one HID lamp the power input goes from about 50 watts at turn on to about 400 watts during steady state over a four minute time period. Since the solid state ballast has relatively constant efficiency, as lamp power needs vary, the current input to the solid state ballast will vary. Thus current input to the solid state ballast will increase substantially during the warm up time. It is this substantial increase of current that is used by the system of this invention.

In brief, a normally closed relay is employed with the relay coil in series in one of the input leads to the ballast. It acts as a current sensing coil. The normally closed contacts of the relay are in series between an auxiliary lamp and the power input terminals.

Thus at cold start, when the HID lamp is turned on, the relatively low current requirements of the ballast leave the normally closed relay in its closed state thereby causing the auxiliary light to turn on. When the increasing current through the input leads to the ballast passes a pre-determined threshold, the relay coil causes the contacts to open and turn off the auxiliary light.

When there is a hot interrupt, the current to the HID drops to close to zero because of the high gas pressure. Thus the input current to the ballast and through the relay coil drops to a point where the relay contacts close and turn on the auxiliary lamp. As HID pressure drops, a point is reached, usually after about one minute, where the ignitor pulses can ionize the gas and turn on the HID lamp. The current demand then builds up to a point which causes the relay contacts to open and the auxiliary light to extinguish.

BRIEF DESCRIPTION OF THE PREFERRED EMBODIMENT

Figure 1:
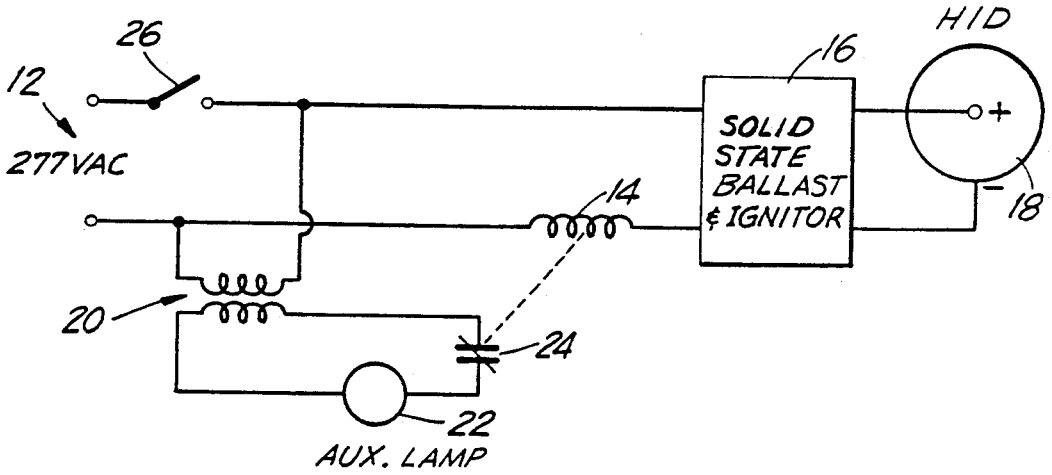
FIG. 1 is an electrical and block schematic of the auxiliary lighting system of this invention applied to an HID lamp having a solid state ballast.

As shown in FIG. 1, input power typically from a 277 volt A.C. source 12 is applied through a relay coil 14 as the input to a solid state ballast and ignitor 16. The known type of solid state ballast 16 provides an appropriate DC output to both ignite and provide power for a known type of high intensity discharge (HID) lamp 18. The input power is also applied through a transformer 20 to provide power to turn on an auxiliary lamp 22. The circuit providing power to the auxiliary lamp 22 includes a normally closed relay contact 24 which contact is associated with the relay coil 14.

When the circuit is turned on by closing switch 26, the initial power requirement of the HID lamp 18 calls for a relatively low input current to the ballast 16. At this initial level of input current, the relay coil 14 does not have sufficient current to open the normally closed contacts 24 so that the lamp 22 is turned on. The lamp 20 remains on until the current level through the relay coil 14 reaches a threshold, at which point the contacts 24 open and the auxiliary lamp 22 turns off. That threshold point is selected so that the auxiliary lamp 22 turns off when the HID lamp 18 has achieved sufficient illumination to warrant turning off the auxiliary lamp 22.

At turn-on, the solid state or electronic ballast 16 is a known type that provides ignitor pulses (for example, 4KV pulses) to ignite the HID lamp 18.

Figure 2:
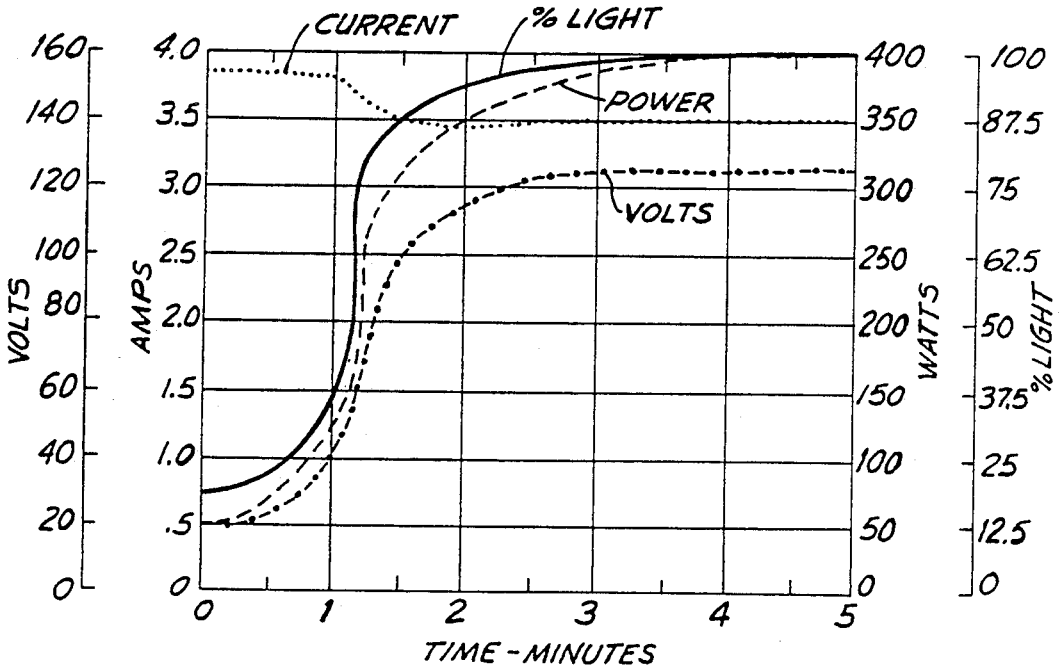
FIG. 2 is a schematic graph of the electrical and illumination characteristics of the HID lamp during cold start.

FIG. 2 represents the relationship between current, voltage, power and illumination during the first few minutes when a typical HID lamp 18 is turned on. The relatively constant current requirements of the HID lamp 18 are accompanied by an initially sharply rising voltage and thus rising power requirement. Because the solid state ballast 16 has a substantially constant efficiency, at least by contrast with the reactor ballast and the two-winding constant current ballasts, the input current requirement to the ballast 16 track with the output power requirements. Since the input to the ballast 16 is from a constant voltage power source 12, this means that input current requirements to the ballast 16 have sharply rising initial operating characteristic similar to the input power requirements for the HID lamp 18. It is this current characteristic which is taken advantage of by the placement of the relay coil 14 and normally closed contacts 24. The relay is preferably set so that the contacts 24 open at a steep portion of the input current operating characteristic curve. In one embodiment, the threshold was set so that the contacts 24 opened when current to the HID was at about 60% of steady state current. Further, relay contacts 24 are preferably of the non chatter type such as is illustrated in FIG. 5 of the U. S. Pat. No. 4,005,331 issued on Jan. 25, 1977 and entitled "High Intensity Discharge Lamp With Auxiliary Light".

During hot interrupt, the current to the HID lamp 18 is extinguished and the solid state ballast 16 which incorporates an ignitor, provides pulses for the purpose of reigniting HID 18. But because the pressure of the gases in the HID is initially high at hot interrupt, the HID 18 does not reignite. As the pressure drops in the HID 18, a point is reached where the pulses from the ignitor component of the ballast 16 are sufficient to reignite the HID.

What happens during this hot interrupt cycle is that the initial nil current requirements of the HID 18 mean that the input current to the ballast 16 is nil and thus the relay contacts 24 close. Once they have closed, the auxiliary lamp 22 is turned on and provides the desired auxiliary lighting. After about a minute or so when the HID 18 pressure drops to the point that the ballast 16 pulses can reignite the HID, current demand increases to a point which calls for enough current through the relay coil 14 to open the contacts 24 and extinguish the lighting from the lamp 22.

Although this invention has been described in connection with particular embodiments, it should be understood that the scope of the invention is defined by the claims and is not necessarily limited to the particular embodiments disclosed.

For example, the system of this invention is employed with known solid state or electronic ballast systems which include an ignitor. An ignitor component of the ballast is required for some, but not all, HID lamps. A mercury HID lamp, for example, does not require an ignitor. This invention can be employed in connection with HID lamps having solid state ballasts which do not include an ignitor. In the latter case, the invention makes possible a simpler auxiliary lamp system employing a single relay rather than two relays to cover both cold start and hot interrupt.

What I claim is:

1. In a high intensity discharge lamp control system having a solid state ballast and power input terminals, the auxiliary lighting arrangement for cold start and hot interrupt comprising:

an auxiliary lamp, and auxiliary input terminals adapted to provide power to said auxiliary lamp, a relay having a coil and a pair of normally closed contacts, said relay contacts being in electrical series between said auxiliary lamp and said auxiliary input terminals to provide power to said lamp from said auxiliary input terminals, said coil being electrical series between said power input terminals and the input terminals to said solid state ballast, said relay contacts opening in response to the magnitude of input current to said ballast rising above a predetermined threshold to cut off power to said lamp from said auxiliary input terminals, said relay contacts remaining closed when the magnitude of input current to said ballast is at a relatively low level.

2. The system of claim 1 wherein said relay contacts are non chatter contacts, said relay contacts opening when the magnitude of the electric current to said ballast is equal to said predetermined threshold.

3. The system of claim 1 wherein said threshold is substantially below the input current level required by said ballast during steady state operation of the high intensity discharge lamp with which said system is to be used.

4. The system of claim 2 wherein said threshold is substantially below the input current level required by said ballast during steady state operation of the high intensity discharge lamp with which said system is to be used.

5. The method of providing auxiliary lighting during cold start and hot interrupt for a high intensity discharge lamp having a solid state ballast comprising the steps of:

responding to the turning on of input power by turning on said auxiliary lamp, sensing the magnitude of the electric current on an input lead to said ballast, responding to the magnitude of electric current in said input lead rising above a predetermined threshold by turning off said auxiliary lamp, and responding to the magnitude of electric current in said input lead falling to a relatively low level by turning on said auxiliary lamp.

* * * * *